US005470258A

United States Patent [19]

Suzuki et al.

[11] Patent Number: 5,470,258

[45] Date of Patent: Nov. 28, 1995

[54] ELECTRICAL CONNECTOR

[75] Inventors: Mitsuru Suzuki, Yokohama; Mikio Shindo, Hachioji; Yoichi Kashiwa, Tokyo, all of Japan

[73] Assignee: The Whitaker Corporation, Wilmington, Del.

[21] Appl. No.: 171,994

[22] Filed: Dec. 22, 1993

[30] Foreign Application Priority Data

Jan. 13, 1993 [JP] Japan ..... 5-019401
Jan. 29, 1993 [JP] Japan ..... 5-006061 U

[51] Int. Cl.[6] ..... H01R 13/40
[52] U.S. Cl. ..... 439/595; 439/752
[58] Field of Search ..... 439/594, 595, 439/752, 592

[56] References Cited

U.S. PATENT DOCUMENTS 5,057,040 10/1991 Kodama et al. ..... 439/595
5,224,883 7/1993 Yamamoto ..... 439/595 X

FOREIGN PATENT DOCUMENTS 1281009 7/1972 United Kingdom .

*Primary Examiner*—Khiem Nguyen
*Attorney, Agent, or Firm*—Adrian J. LaRue; Timothy J. Aberle

[57] ABSTRACT

The receptacle contact (10) includes a box-shaped contact section (12) with its upper wall folded over to provide protrusions (36) to abut against the tip of a resilient arm (48). Such receptacle contacts (10) are inserted into contact receiving cavities (42) in the connector housing (44). A double-lock member (150) may be used for double locking the contacts.

18 Claims, 6 Drawing Sheets

ELECTRICAL CONNECTOR

The present invention relates to a receptacle contact and a connector using such receptacle contacts with or without a double-lock member.

BACKGROUND OF THE INVENTION

Matable connectors using one or more male and female contacts have been used widely for interconnecting electrical circuits in consumer electrical or electronic appliances, automobiles, etc. Typical and widely used male contacts are commonly referred to as tab contacts each having a relatively wide contact surface. On the other hand, typical and most widely used receptacle contacts have box-shaped contact sections as disclosed in Japanese UM laid-open No. 64 (1989)-38777. Advantages of this type of receptacle contact are relatively rugged in construction to well-protect the inner contact member from external stress. Such contacts are generally received and retained in contact receiving cavities in a connector housing by engaging a respective resilient arm formed in each contact receiving cavity with the box-shaped contact section at the rear end thereof.

For more reliable retention of the receptacle contacts in the connector housing, a double-lock member is employed to be mounted on the connector housing for engaging with other parts of such receptacle contacts. In this way, each receptacle contact is reliably retained in the connector housing by both the resilient arm in each contact receiving cavity, and the double-lock member in such particular applications as automobiles subjected to strong vibration and shock.

When the receptacle contact is being inserted into the contact receiving cavity in the housing, the resilient arm is slid over the upper surface of the box-shaped contact section of the receptacle contact by being deflected against the resiliency of the resilient arm. The box-shaped contact section of the receptacle contact needs to have a certain length to maintain effective contact length with the matable male contact. While the resilient arm contacts the upper surface of the contact section, the receptacle contact is subjected to pressure by the resilient arm. The frictional force by the pressure acts as the insertion force of the contact section. It is, therefore, possible that the operator would stop inserting the contact before the resilient arm reaches the rear end of the contact section.

Also, the receptacle contact as disclosed in the above mentioned UM specification has a very limited area to effectively abut against the resilient arm when the resilient arm engages the contact section at the rear end thereof because the upper wall or surface of the contact section is made of a single sheet of metal plate. As a result, when a pulling force is applied to the contact, the resilient arm is often sheared or broken by the relatively sharp edge at the rear end of the contact section.

It is therefore an object of the present invention to provide a receptacle contact free from the above problem, and to provide a connector for using such a contact or contacts; that is, to provide such a contact with improved loading resistance and to prevent damage of the resilient arm in the housing.

Additionally, electrical connectors for certain applications, e.g., automobiles and the like, require enhanced or more reliable resistance to a tensile force applied to the contacts, thereby utilizing a double-lock member to provide additional retention force to the contacts. Such a double-lock member is conveniently mounted on the housing after the contacts have been loaded in the respective contact receiving cavities in the housing. However, there is an instance where the double-lock member must be removed for replacing any defective contact or repositioning the contacts once loaded in the cavities.

It is therefore an additional object of the present invention to provide a double-lock connector in which the double-lock member can be easily removed, if required, by using a simple tool, e.g., a screw driver or the like.

SUMMARY OF THE INVENTION

In order to overcome the above problems and achieve the intended objects, a receptacle contact according to the present invention has a box-shaped contact section made by stamping and forming a metal stock with the upper wall of the receptacle section partly folded over at the rear end thereof to obtain a double thickness wall for engagement with the resilient arm in the contact receiving cavity.

The connector according to the present invention comprises a housing formed with contact receiving cavities to receive receptacle contacts. Each receptacle contact has a box-shaped contact section having a folded upper wall at the rear end thereof to provide a double thickness upper wall to engage the resilient arm in each of the contact receiving cavities.

The connector according to the present invention comprises a housing, at least one receptacle contact and a double-lock member. One or more contact receiving cavities is formed in the housing to receive the contact and each cavity is formed with a resilient arm to engage the contact at the rear end of the contact section which is partly folded over to provide a double thickness upper wall. The double-lock member is removably mounted on the housing to engage the other part of the contact for assured retention of the contacts in the respective contact receiving cavity.

BRIEF DESCRIPTION OF DRAWINGS

FIGS. 1 and 2 are embodiments of the receptacle contact according to the present invention, wherein FIG. 1 is a plan view and FIG. 2 is a partly cross sectional side view.

FIGS. 5 and 6 show the instance when the contact in FIG. 1 is being inserted up-side-down into the cavity in the housing, wherein FIG. 5 is a cross section view while FIG. 6 is a view seen from the direction of the arrow "B" in FIG. 5.

DETAILED DESCRIPTION OF THE INVENTION

Figure 1:
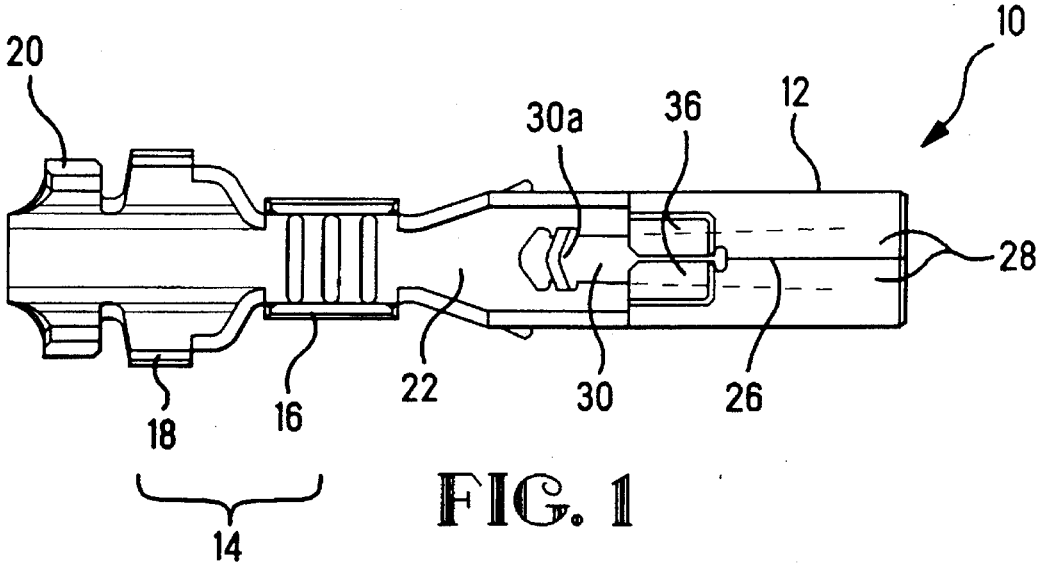
Figure 2:
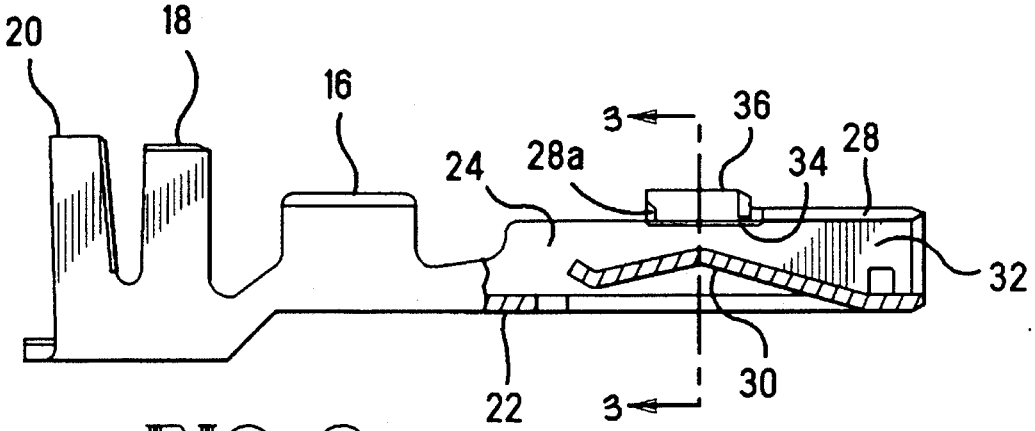

In FIGS. 1 and 2, the receptacle contact 10 is made by stamping and forming a single sheet of copper alloy. It comprises a generally box-shaped contact section 12 at one end, and a crimping section 14 for making electrical connection to an electrical wire at the other end. The crimping section 14 comprises a wire barrel 16 to be connected to the conductor of the electrical wire, and an insulation barrel 18 to hold on an insulator of the electrical wire. Here, it is to be noted that a double-lock barrel 20 abutting a double-lock member 46 (FIG. 4) is formed adjacent to the insulation barrel 18.

Figure 3:
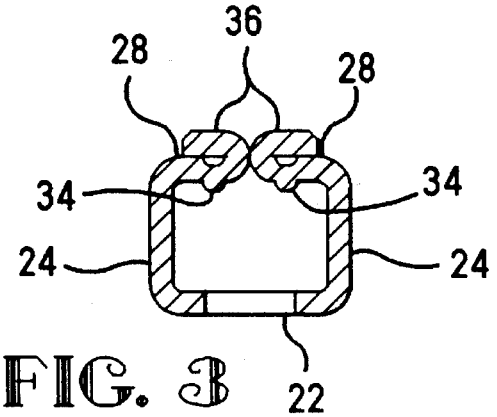
FIG. 3 is a cross section view along the line 3—3 in FIG. 2.

The contact section 12 is formed in a generally box shape comprising a bottom wall 22, opposite sidewalls 24, 24 and upper walls 28, 28 with the edges thereof abutting against each to other to form a seam 26. There is formed a contact spring leaf 30 inside the contact section 12 by slitting and lifting the bottom wall 22. The contact spring leaf 30 extends from an entrance 32 for a matable contact (not shown) toward the crimping section 12. As shown by phantom lines in FIG. 1, the contact spring leaf 30 becomes narrower toward its tip 30*a* and is made wider at the tip 30*a*. As a result, when the matable male contact (not shown) is to be inserted between ribs 34, 34 (FIG. 3) in the upper walls 28, 28 and the contact spring leaf 30, the wider tip 30*a* abuts against the bottom wall 22. The contact spring leaf 30 is substantially acting as a beam with the tip 30*a* abutting against the bottom wall 22, thereby providing high contact force.

The upper walls 28, 28 of the contact section 12 are partly folded over to form protrusions 36, 36 whose functions will be described hereinafter.

Figure 4:
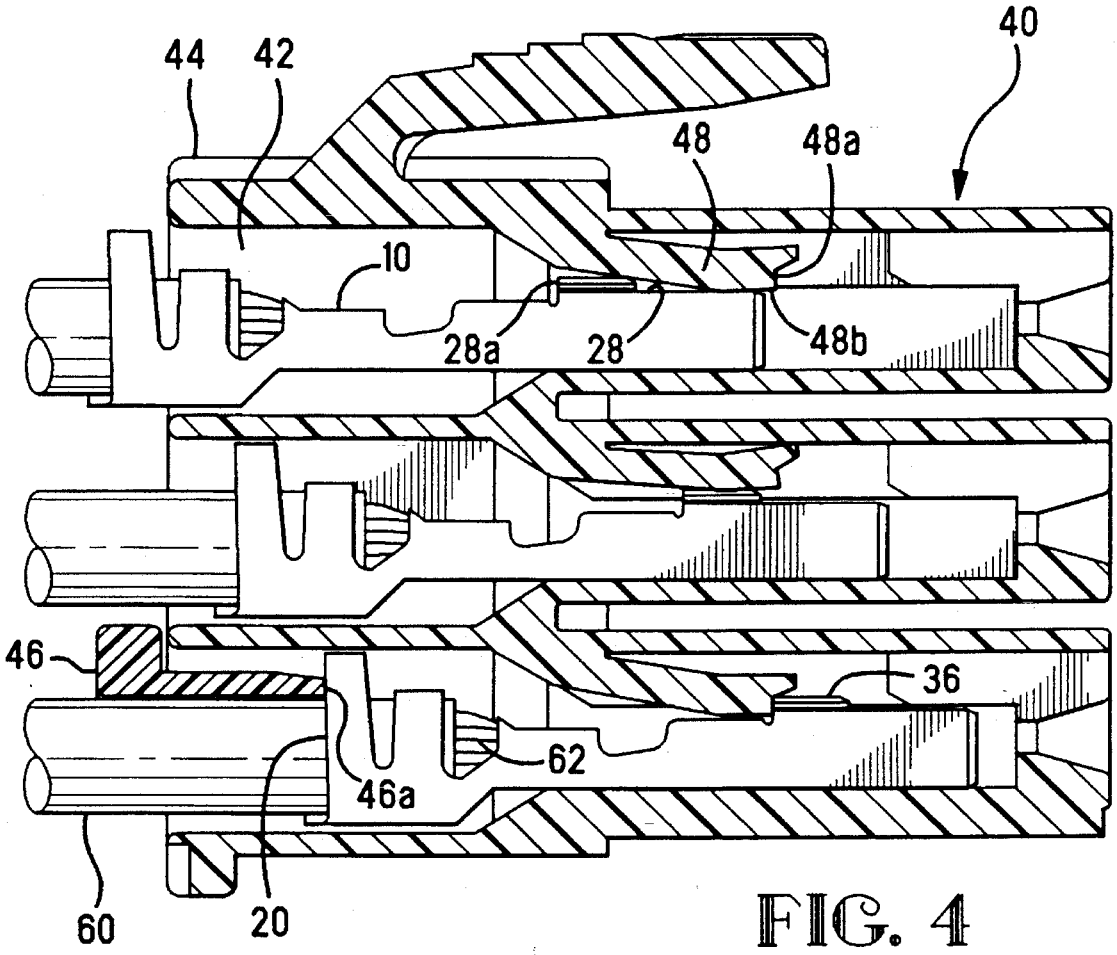
FIG. 4 is a cross section view of the contacts in FIG. 2 showing the process of inserting the contacts into the housing.

Illustrated in FIG. 4 is a cross-sectional view showing the process of inserting the contacts as shown in FIGS. 1 and 2 into the housing. It is to be noted, however, that the contacts are not cross sectional. A connector 40 comprises a plurality of contacts 10, a housing 44 formed with a plurality of cavities 42 for receiving the contacts 10, and a plurality of double-lock members 46 (only one is shown if FIG. 4) for secondary locking of each row of contacts 10. Similar to conventional connectors, formed inside each cavity 42, is a resilient arm 48 extending from the inner wall of the housing 44. Each contact 10 is inserted into the cavity 42 from one end thereof against the resiliency of the resilient arm 48 and is secured in the housing 44 by engaging an engaging surface 48*a* of the resilient arm 48 and a rear end 28*a* of the upper wall 28 of the contact 10.

The above mentioned protrusions 36, 36 formed on the upper walls 28 of each contact 10 increase apparent or effective thickness of the upper walls 28, 28 at the rear ends 28*a*, thereby increasing the area abutting against the engaging surface 48*a* of the resilient arm 48. As a result, when a force is applied to the contact 10 in the direction of pulling out the contact 10, pressure on the engaging surface 48*a* is reduced to effectively protect any damage of the resilient arm 48. Also, since the protrusions 36, 36 are folded over along the seam 26 or the center line of the contact 10, the folded section is shorter as compared with the width of the contact section 12, thereby providing a relatively strong construction to the pressure at the tip of each protrusion 36 by the resilient arm 48. Additionally, the protrusion 36 is formed at one part of the rear end of the upper wall 28, thereby occupying only a fraction of the entire length of the contact section 12. As illustrated by the upper most and middle contacts in FIG. 4, the amount of deflection of the resilient arm 48 is smaller when the bottom surface 48*b* abuts against the upper wall 28 than when abutting against the upper surface of the protrusion 36, thereby providing a smaller insertion force or resistance. That is, the insertion force will be increased at the final insertion stage when the protrusion 36 and the resilient arm 48 slide against each other. This means that the total insertion force is reduced for ease of insertion operation and providing a "click feeling" to the operator indicating the complete insertion of the contact 10. Also, since the contact section 12 of each contact 10 is vertically asymmetrical, up-side-down insertion of the contact 10 into the cavity 42 in the housing 44 is effectively avoided as described in greater detail hereinafter.

As illustrated at the bottom of FIG. 4, the contact 10 is completely inserted into the cavity 42 and is double locked by inserting the double-lock member 46 into the cavity 42 at the one end. It is to be noted that, even if the contact 10 is not completely inserted into the cavity 42, the tip or front end 46*a* of the double-lock member 46 will push the double-lock barrel 20 to completely insert the contact 10 into the cavity 42.

Figure 5:
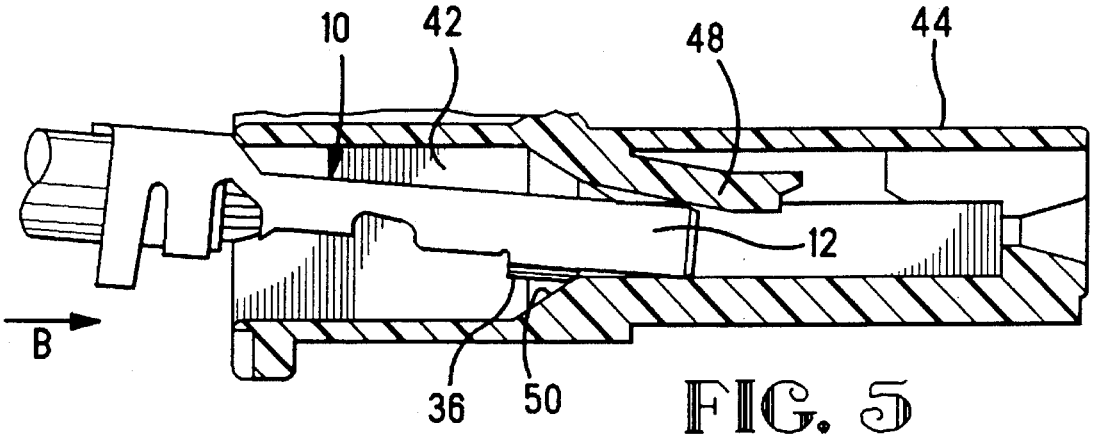
Figure 6:
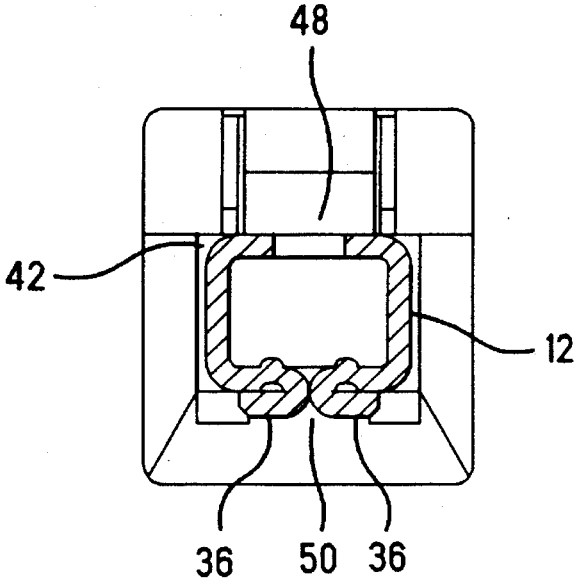
Figure 7:
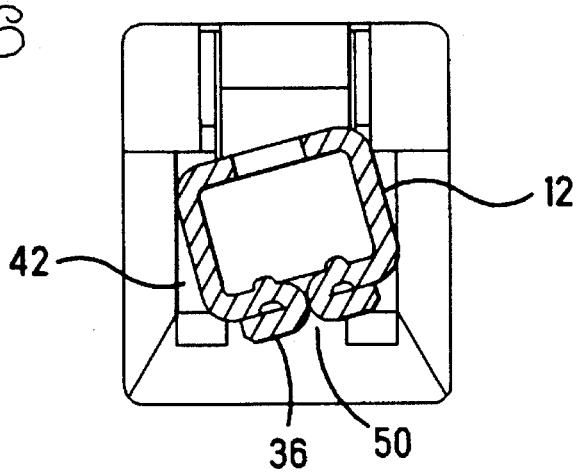
FIG. 7 is a drawing similar to FIG. 6 showing the instance when the contact in FIG. 1 is being inserted up-side-down and slanted in a manner into the cavity in the connector housing.

Illustrated in FIGS. 5 and 6 is the contact in FIG. 1 which is being inserted up-side-down into the housing. FIG. 5 is a cross-sectional view while FIG. 6 is the end cross-sectional view in the direction of arrow B in FIG. 5. On the other hand, FIG. 7 shows a condition similar to FIG. 5 but the contact 10 is being inserted in a slanted and up-side-down manner. As shown in FIGS. 5 and 6, when one attempts to insert the contact 10 up-side-down into the cavity 42, the protrusions 36, 36 of the contact 10 abut against a sloped surface 50 in the cavity 42, thereby preventing the contact 10 from being inserted further into the cavity 42. As a result, up-side-down insertion of the contact 10 is effectively protected. Also, as shown in FIG. 5, even if an attempt is made to insert the contact 10 up-side-down with slight tilt, at least one protrusion 36 never fails to abut against the surface 50, thereby effectively protecting full insertion in this orientation. In the connector according to the present invention, the aforementioned up-side-down insertion protection of the contact is achieved by using the relatively low profile protrusions 36 instead of the use of conventional stabilizers extending from the side wall of the contact, thereby providing low profile connectors having an up-side-down contact insertion protection capability. In addition, undesired entangling of contacts 10 after crimping electrical wires is significantly reduced.

Figure 8:
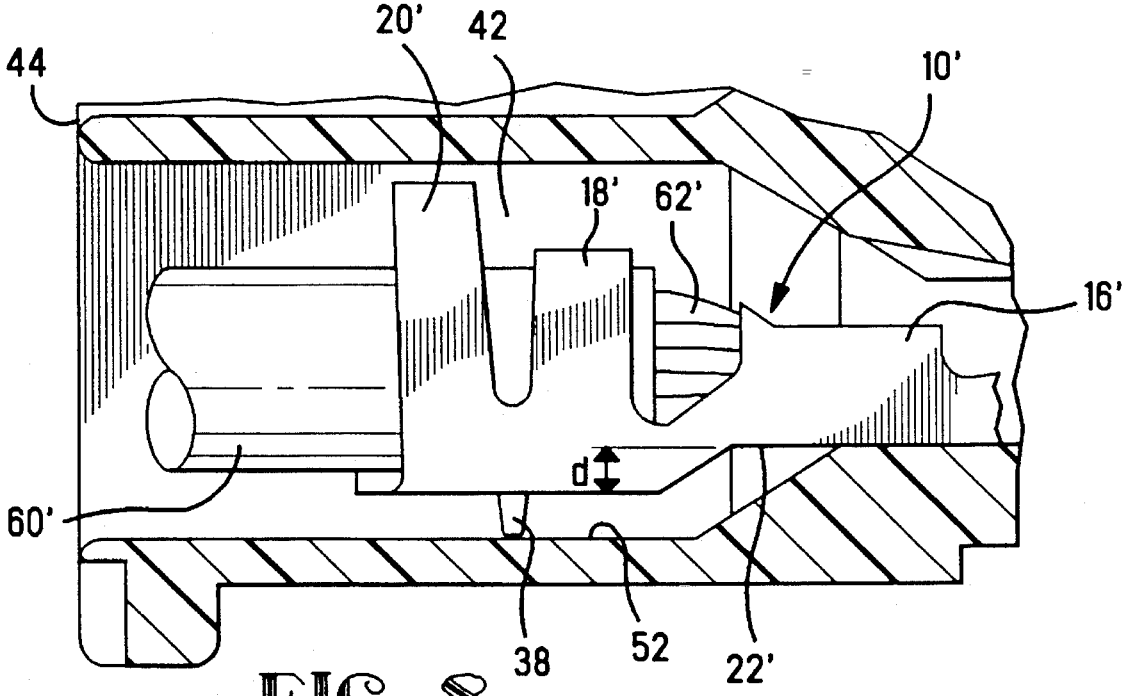
FIG. 8 is a cross sectional view of a connector accommodating a contact for an electrical wire having smaller insulation diameter.

Illustrated in FIG. 8 is a cross-sectional view of the connector for receiving contacts for terminating to relatively small diameter insulated wire. Note that the contact itself is not shown in cross section. In some applications of the connector, there are two cases for using relatively large diameter insulated electrical wires 60 (see FIG. 4) and relatively small diameter insulated electrical wires 60' (see FIG. 8). In the latter case, it is required to use the insulation barrels 18' with a relatively shallow depth d in order to obtain reliable crimping of the core wires 62' and the wire barrel 16'. Unfortunately, however, in order to insert both the former and the latter contacts 10, 10' into the same cavity 42 in the housing 44, there is a clearance between the insulation barrel 18' of the latter contact 10' and the isolation wall 52 of the housing 44. As a result, there may be vibration of the contact 10' inserted into the cavity 42 or improper engagement between the double-lock-barrel 20' and the double-lock member 46 due to slanted positioning of the contact 10'. Such a problem can be avoided by forming a projection 38 in the bottom wall of the contact 10' at the position between the insulation barrel 18' and the double-lock barrel 20' to compensate for the clearance.

Now, another embodiment of the double-lock electrical connector according to the present invention will be described hereunder by reference to accompanying FIGS. 9 through 14.

Figure 9:
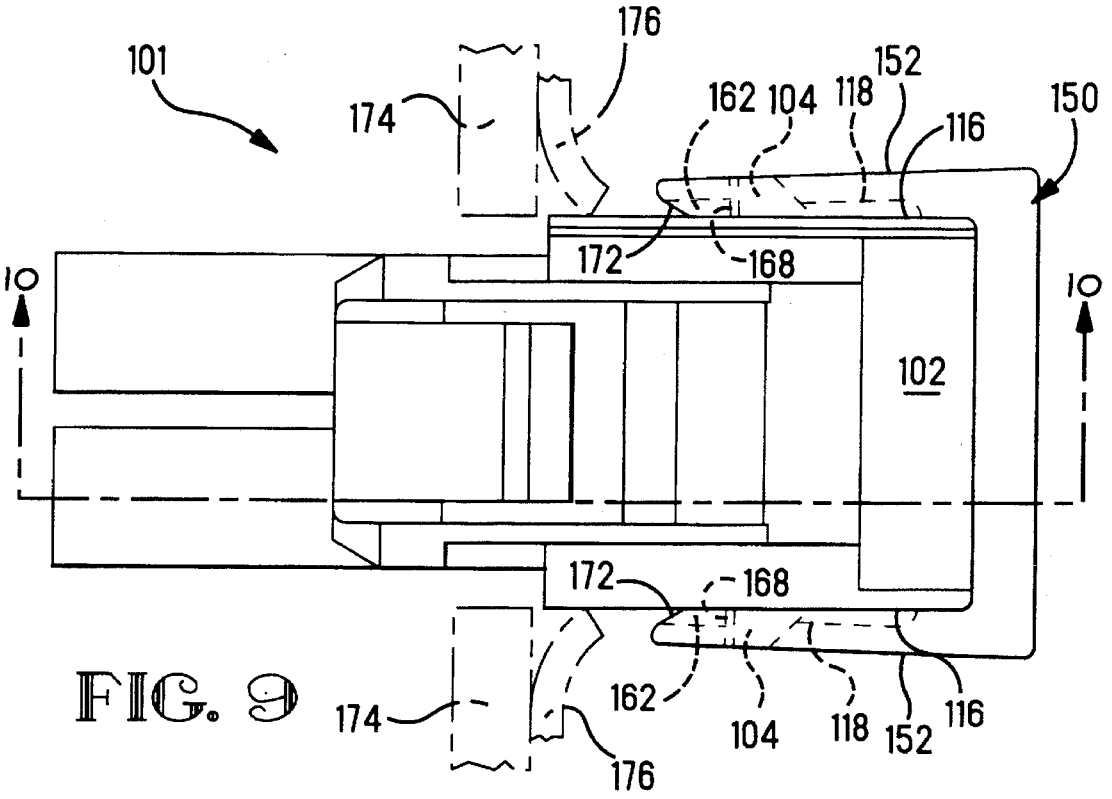
FIG. 9 is a plan view of the double-lock electrical connector according to the present invention.
Figure 10:
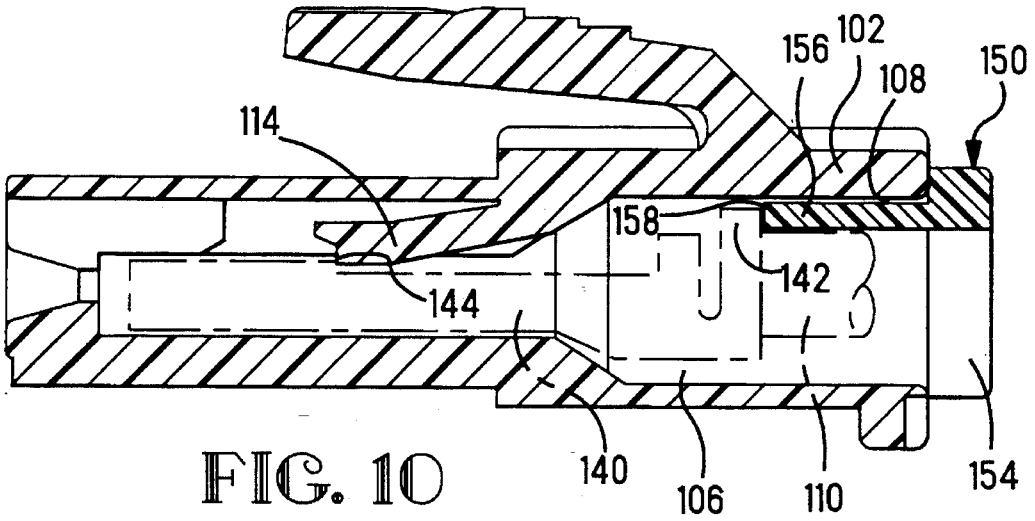
FIG. 10 is a longitudinal cross sectional view of the electrical connector in FIG. 9 along the line 10—10.

Illustrated in FIG. 9 is a plan view of the electrical connector 101. An insulating housing 102 for the connector 101 is illustrated in FIG. 10. A double-lock member 150 is installed on the housing 102 at the rear portion thereof. Cantilever arms 152 are formed with the double-lock member 150 at both ends thereof. A latch engagement between the double-lock member 150 and the housing 102 is formed by projections 104 on both side surfaces 116 of the housing 102 and slots 164 in the arms 152 of the double-lock member 150, thereby preventing rearward removal of the double-lock member 150.

The arms 152 are formed with channels 162 at the end portions thereof. When the double-lock member 150 is being inserted, the channels 162 are mated with corresponding ribs 118 formed on the side surfaces 116 of the housing 102 for smoothly guiding the engagement with the projections 104. Preferably, taper surfaces 172 are formed at the leading ends of the arms 152 for ease of installation of the double-lock member 50. The connector is designed to mount, for example, a sealing rubber 176 to prevent foamed material and the like to enter when mounted on an isolation wall 174 of an electric refrigerator. In this particular case, it was conventionally impossible to remove the double-lock member because there is no room to insert a tool to deform the arms 152 outwardly. However, the double-lock member 150 according to the present invention is removable and the way of removing it will be described hereinafter.

Illustrated in FIG. 10 is a longitudinal cross-sectional view along line 10—10 in FIG. 9. The way of enhancing the retention of a terminal 140 within the housing 102 by the double-lock member 150 is best shown in FIG. 10. A main body 154 of the double-lock member 150 is essentially closing an opening (or entrance) 108 of a cavity 106 in the housing 102 to receive the terminal 140. A plate-like tongue (retention member) 156 at the upper portion of the main body 154 extends into the cavity 106 to abut against a barrel 142 at the rear portion thereof for crimping an electrical wire 110. Such abutment between the tip 158 of the tongue 156 and the barrel 142 along with the engagement between a notch 144 at the top of the terminal 140 and the housing lance 114 provides resistance of the terminal 140 to the pulling force in the back direction.

Figure 11:
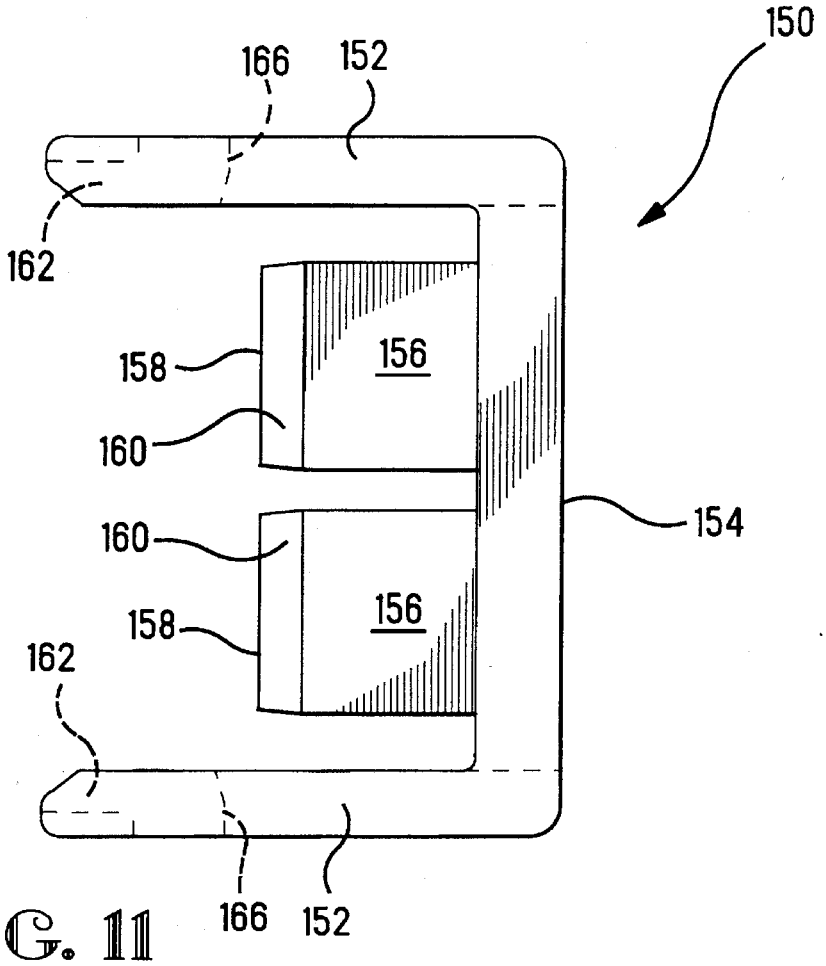
FIG. 11 is a plan view of the double-lock member to be used for the electrical connector in FIG. 9.

Shown in FIG. 11 is a plan view of the double-lock member 150. It is for a two terminal connector 101 as shown in FIG. 9, thereby having a pair of tongues 156 to retain two terminals 140. Tapered surfaces 160 are formed at the tip 158 of each tongue 156 for smooth insertion into the respective cavity 106. There is a clearance between each tongue 156 and the arm 152 to receive the thickness of the housing 102. Also, there is a gap between adjacent tongues 156 to receive the isolation wall between the cavities 106 in the housing 102.

Figure 12:
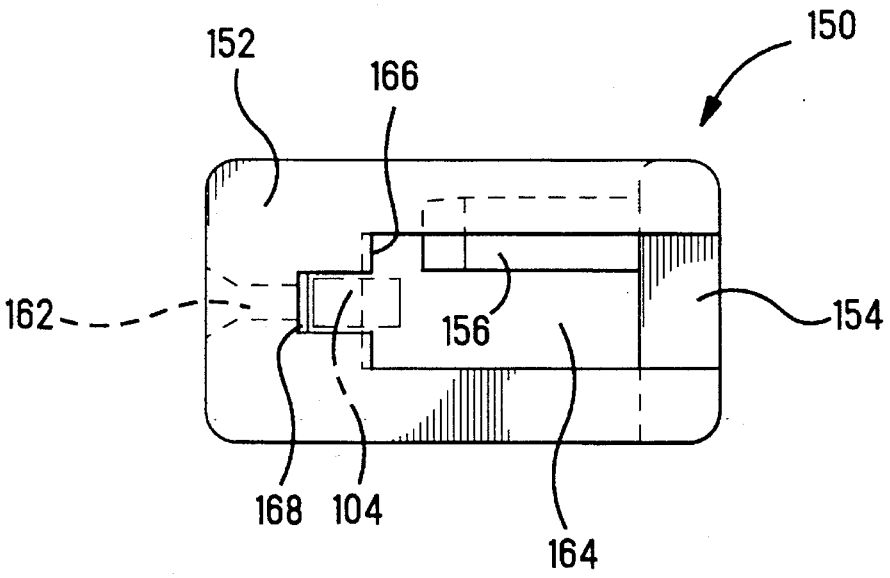
FIG. 12 is a front view of the double-lock member in FIG. 11.

FIG. 12 is a front view of the double-lock member 150. Slots 164 extending in the longitudinal direction are formed with the arms 152 by cutting the main body 154. The slots 164 are closed at the front ends thereof and are formed into upper and lower sections. The lower section has an engaging surface (latch section) 168 to engage the projection 104 of the housing 102. The engaging surface 168 is provided with a taper from the outer surface to the inner surface of each arm 152 and cooperates with the projection 104 of the hosing 102 having essentially the same taper, thereby preventing the arm 152 from being removed. An engaging surface (tool engaging section) 166 in the upper section of the slot 164 is positioned behind the engaging surface 168 and having a taper in the opposite direction. For releasing the engagement between the engaging surfaces 168 and the projections 104, a tool such as a pin, tweezers, a screw driver and the like (not shown) is inserted into the engaging surfaces 166 from the side of the main body 154. The tool is then rotated with the mainbody 154 as the fulcrum so that the arms 152 are deflected outwardly for releasing the engagement. The tip of the tool is guided by the taper on the engaging surface 166 between the arm 152 and the housing 102, thereby providing assured deflection of the arms 152 by the tool. Such operation is very simple because it is visible outside of the housing 102. A proper size of the tool is chosen to fit the engaging surface 166. As described above, the engaging surfaces 166 help to insert the tool into the slots 164 from the rear side of the arms 152 for deflecting the arms 155 without providing the room in front of the arms 152.

In the shown embodiment, the engaging surfaces 168 are formed in the same slots 164 as the engaging surfaces 166. It is noted, however, that openings separated from the slots 164 can be formed to engage with the projections 104.

Figure 13:
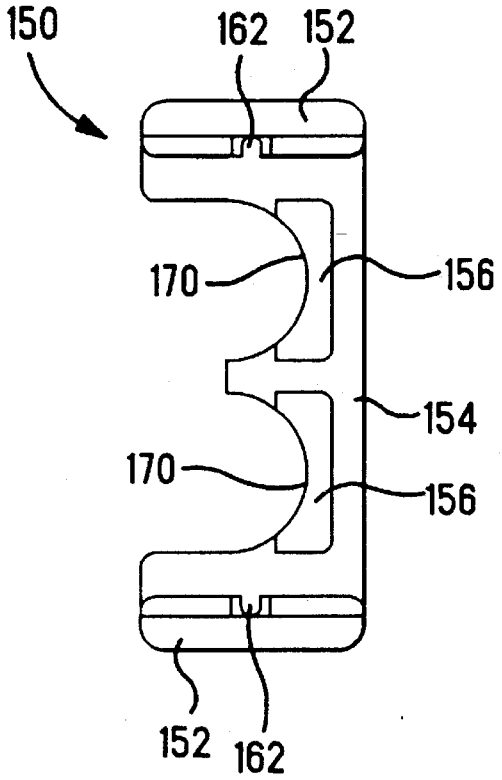
FIGS. 13 and 14 are left and right side views of the double lock member in FIG. 11.

Illustrated in FIG. 13 is a left side view of the double-lock member 150 in FIG. 11. There are formed two arcuate cut-away sections 170 to fit the circumference of the electrical wire 110 at the lower surface of the mainbody 154 and the tongues 156.

Figure 14:
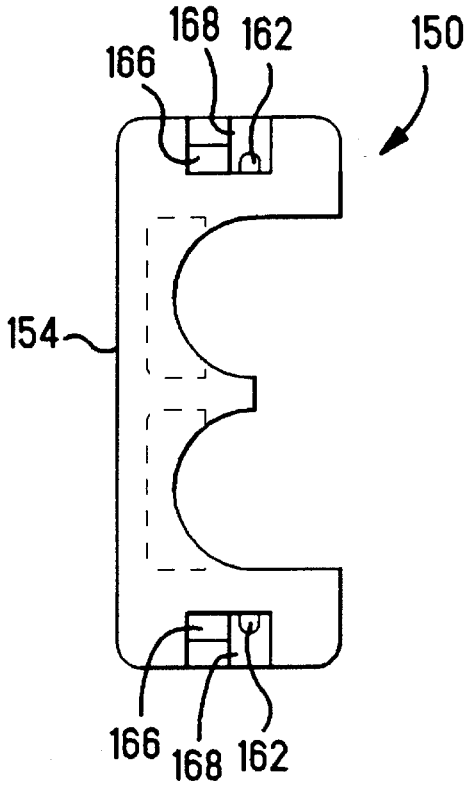

FIG. 14 is a right side view of the double-lock member 150 in FIG. 11. The engaging surfaces 166 for inserting a tool to release the latch engagement is best shown in FIG. 14.

It is to be understood that the present invention is not limited to the shown preferred embodiments. That is, various modifications can be made without departing from the subject matter of the present invention. For example, the connector may have more than two contact terminals by increasing the width of the double-lock member to have the corresponding number of tongues. Alternatively, the connector may have plural rows of contact terminals in a matrix manner. In this case, a plurality of double-lock members may be used to lock contacts in each row.

The receptacle contact and the connectors using such contacts according to the present invention have significant practical advantages. The receptacle contact having the protrusions formed by partly folding over the upper walls of the box-shaped contact section at the rear end thereof reduces the insertion force, thereby improving the insertion operation. The increased area abutting against the resilient arm in the housing effectively protects any damage of the resilient arm when a tensile force to pull out the contact is applied to the contact. Additionally, the protrusions in the contact prevent the contact from being inserted up-side-down into the housing and also reduce entangling of the contacts. Also, the connector is low profile with an up-side-down insertion protection feature. Furthermore, the connector can be provided with a double-lock member easily removable using a simple tool.

We claim:

1. An electrical connector assembly comprising:

an insulated housing member with a plurality of contact receiving cavities therein, at least one of said cavities includes a resilient arm which is formed on a wall of said at least one cavity, an electrical contact for insertion into said at least one cavity, said contact having a general box shape with an upper wall portion, said upper wall portion having an upwardly extending projection for sliding engagement with said resilient arm and contact with an end surface of said resilient arm;

and a double lock member for retaining said contact in said housing;

whereby, when said contact is inserted into said at least one cavity said projection engages and deflects said resilient arm for an initial low insertion force, and as the contact is inserted further the insertion force increases as a portion of said resilient arm engages said cavity wall, and when said contact is fully inserted said projection contacts the end surface of said resilient arm thereby retaining said contact in said at least one cavity against separation forces.

2. The electrical connector assembly of claim 1, wherein the electrical contact includes a wire termination portion having a double-lock barrel member for engaging the double-lock member.

3. The electrical connector assembly according to claim 2, wherein the double-lock member engages said double-lock barrel and said housing for retaining said contact in said at least one cavity.

4. The electrical connector assembly of claim 2, wherein the double lock member has a tongue portion which engages said double-lock barrel, and leg portions which extend along the outside of said housing.

5. The electrical connector assembly of claim 2, wherein said double-lock member has leg portions extending on opposed outside surfaces of said housing, and said housing includes ramp surfaces for deflecting said legs.

6. An electrical connector assembly comprising: an insulated housing member with a plurality of contact receiving cavities therein, at least one of said cavities includes a resilient arm which is formed on a wall of said at least one cavity, an electrical contact for insertion into said at least one cavity, said contact having a general box shape with an upper wall portion, said upper wall portion having an upwardly extending thickened projection centrally of said upper wall portion for sliding engagement with said resilient arm and engagement with an end surface of said resilient arm thereby retaining said electrical contact within said at least one cavity, and a double lock member for retaining said contact in said housing.

7. The electrical connector assembly of claim 6, wherein, when said contact is inserted into said at least one cavity said projection engages and deflects said resilient arm for an initial low insertion force, and as the contact is inserted further the insertion force increases as a portion of said resilient arm engages said cavity wall, and when said contact is fully inserted said projection contacts the end surface of said resilient arm thereby retaining said contact in said at least one cavity against separation forces.

8. The electrical connector assembly of claim 6, wherein the electrical contact includes a wire termination portion having a double-lock barrel member for engaging the double-lock member.

9. The electrical connector assembly according to claim 8, wherein the double-lock member engages said double-lock barrel and said housing for retaining said contact in said at least one cavity.

10. The electrical connector assembly of claim 8, wherein the double lock member has a tongue portion which engages said double-lock barrel, and leg portions which extend along the outside of said housing.

11. The electrical connector assembly of claim 8, wherein said double-lock member has leg portions extending on opposed outside surfaces of said housing, and said housing includes ramp surfaces for deflecting said legs.

12. An electrical connector assembly comprising: an insulated housing member with a plurality of contact receiving cavities therein, at least one of said cavities includes a resilient arm which is formed on a wall of said at least one cavity;

an electrical contact for insertion into said at least one cavity, said contact having an upper portion, said upper portion includes a thickened projection centrally of said upper portion for sliding engagement with said resilient arm and engagement with an end surface of the resilient arm thereby retaining said electrical contact within said at least one cavity, a double lock member for retaining said contact in said housing; and said contact includes a wire termination portion having a double-lock barrel member for engaging the double-lock member.

13. The electrical connector of claim 12, wherein the double-lock member engages said double-lock barrel and said housing for retaining said contact in said at least one cavity.

14. The electrical connector of claim 13, wherein said double-lock member has a tongue portion for engaging said double-lock barrel.

15. The electrical connector of claim 13, wherein the double-lock member has at least one deflectable leg portion which extends along the outside of said housing.

16. The electrical connector of claim 15, wherein the housing includes at least one ramp surface for deflecting said leg.

17. An electrical connector comprising:

an insulated housing having a contact-receiving cavity;

a resilient arm provided by a wall of said contact-receiving cavity extending downwardly from the wall and toward a front end of said housing;

an electrical contact insertable into said contact-receiving cavity and including a contact section and a wire-connection section; and an upper portion of said contact section adjacent an inner end of said contact section being folded over thereby forming a protrusion extending above a surface of said upper portion;

whereby said protrusion is engaged by an engaging surface of said resilient arm when the electrical contact is fully inserted into said contact-receiving cavity thereby retaining said electrical contact therein.

18. An electrical connector as claimed in claim 17, wherein said wire-connecting section includes a double-lock barrel member, and a double-lock member latchably mounted on said housing and having an engaging section engaging said double-lock barrel member.

* * * * *